United States Patent [19]

Gotoh et al.

[11] 4,135,554

[45] Jan. 23, 1979

[54] DEVICE FOR DETECTING THE LOSS OF TENSION OF A WARP YARN IN A WEAVING LOOM

[76] Inventors: Miyuki Gotoh, 4-48-21, Midori-cho, Tokorozawa City; Eizi Ichimatsu, 5-12-23, Midori-cho, Koganei City, Tokyo, both of Japan

[21] Appl. No.: 840,485

[22] Filed: Oct. 7, 1977

[30] Foreign Application Priority Data

Oct. 16, 1976 [JP] Japan ..... 51/138343[U]
Aug. 3, 1977 [JP] Japan ..... 52/103254[U]

[51] Int. Cl.[2] ..... D03D 51/32
[52] U.S. Cl. ..... 139/337; 139/355
[58] Field of Search ..... 139/336, 337, 355, 356

[56] References Cited

U.S. PATENT DOCUMENTS

| | | | |
|---|---|---|---|
| 1,770,562 | 7/1930 | Wagner | 139/355 |
| 1,878,043 | 9/1932 | Wagner | 139/355 |
| 1,962,509 | 6/1934 | Kaufmann | 139/337 |

FOREIGN PATENT DOCUMENTS

| | | | |
|---|---|---|---|
| 2308699 | 9/1974 | Fed. Rep. of Germany | 139/337 |

*Primary Examiner*—Henry S. Jaudon
*Attorney, Agent, or Firm*—Robert E. Burns; Emmanuel J. Lobato; Bruce L. Adams

[57] ABSTRACT

At least one elongate electrode is positioned on the upper surface of an upper heddle bar of each heddle frame of a loom for constituting a switch with loops loosely coupled to the upper heddle bar, each loop being spaced from the upper surface of the upper heddle bar at the lower position of the heddle bar due to upward force along the heddle produced by the tension of a warp, the switch being closed when a loop hangs over the electrode by its self weight due to loss of tension along the warp at the lower position of the heddle bar, the lower position of each heddle bar being detected by a heddle bar position detector, a corresponding LED being illuminated by a display circuitry connected to the switch and the heddle bar position detector, the circuitry including holding circuits for maintaining the illumination of the LED from the first glowing until the holding circuit is reset.

8 Claims, 12 Drawing Figures

DEVICE FOR DETECTING THE LOSS OF TENSION OF A WARP YARN IN A WEAVING LOOM

FIELD OF THE INVENTION

This invention relates to a device for detecting the loss of tension of a warp yarn in a weaving loom.

BACKGROUND OF THE INVENTION

In a conventional weaving loom an operator has to find a heddle to which an abnormal warp belongs by pushing a plurality of heddles aside. It usually takes a long time to find it because the operator has to find it by guess of the place where the abnormal warp is or by a clue of waste of yarn coming out of the loom. Therefore finding a heddle to which an abnormal warp belongs is really troublesome, especially in a dobby which has many heddle frames.

SUMMARY OF THE INVENTION

The present invention has been proposed to facilitate a detection of a heddle to which an abnormal warp belongs. When a warp is broken or loosened a signal representative of loss of tension of warp is transmitted from detection means disposed on a heddle frame to which the warp belongs and a lamp corresponding to the heddle frame glows by a signal through a lamp illuminating circuit. The detection means can be divided into more than two portions in a heddle frame so that a plurality of lamps corresponding to the portions are provided for displaying an approximate place of a heddle to which an abnormal warp belongs.

It is a primary object of the present invention to provide a device, for displaying the loss of tension of a warp, which indicates a heddle frame or a portion in a heddle frame to which the abnormal warp belongs by illuminating at least a lamp among a plurality of lamps corresponding to each heddle frame or the portion respectively.

It is another object of the present invention to provide a device for displaying the loss of tension of a warp which facilitate the detection of a heddle to which an abnormal warp yarn belongs.

It is a further object of the present invention to provide such a device in which a lamp maintains glowing until a lamp illuminating circuit is reset.

BRIEF DESCRIPTION OF THE DRAWINGS

Other features, objects and advantages of the present invention will be more apparent as the description of the preferred embodiment proceeds taken in conjunction with the appended drawings in which.

DETAILED DESCRIPTION OF THE PREFERRED EMBODIMENT

Figure 1:
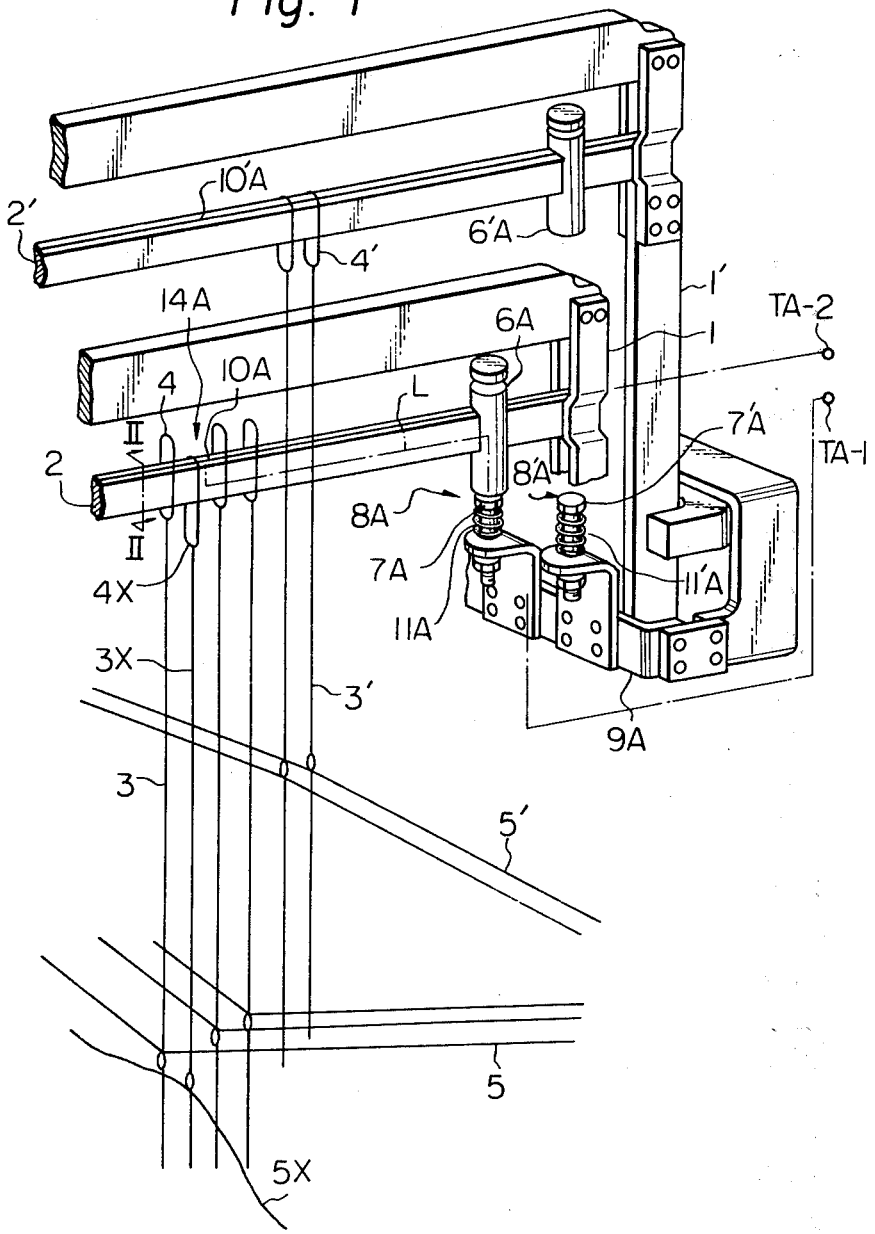
FIG. 1 shows a partly perspective view of a first preferred embodiment of a device for detecting the loss of tension of a warp yarn according to the present invention.

Reference is now made to FIG. 1 which shows first preferred embodiment according to the present invention. Though each heddle frame 1, 1' includes a pair of heddle bars only the heddle bars 2, 2' disposed on the upper portions are shown in the figure. A plurality of one group of heddles 3 made of wires are movably attached by loops 4 to the heddle bar 2 and the other group of heddles 3' to the other bar 2' by loops 4'. Each heddle 3, 3' has its eye of a needle for supporting a warp yarn. In the operation of the loom, especially in shedding, heddle bars 2, 2' and other heddle bars on the opposite side which are not shown move reciprocatively and alternately raising and lowering the two groups of warp yarns 5, 5' via heddles 3, 3'. As shown in FIG. 1, when the heddle bar 2' is at an upper portion pulling and thus raising a plurality of heddles 3', the loops 4' are fully pulled respectively downward because of the tension along the warps 5'. On the other hand when the heddle bar 2 is at an lower portion, the top portion of each loop 4 has a space with respect to the upper portion of the heddle bar 2 because heddles 3 receive upward force by way of tension along the warps 5.

The heddle bars 2, 2' are made of electro-conductive material and at its one end of each heddle bars 2, 2' are disposed electrodes 6A, 6'A respectively while another electrodes, 7A, 7'A are disposed via an insulating member 9A on the body (no numeral) of the loom to contact the electrodes 6A, 6'A respectively when the heddle frame 1 or 1' moves downward. Thus the combination of electrodes 6A and 7A and also the combination of electrodes 6'A and 7'A form a pair of first electric switches 8A, 8'A respectively for detecting the lower position in the movement of the heddle frame 1, 1' i.e. heddle bars 2, 2'.

The electrodes 7A, 7'A disposed on the insulating member 9A which is fixedly connected to the body are further arranged to be reciprocatively movable by means of springs 11A, 11'A for absorbing the pressure which may be produced by the fluctuation of the strokes of the movement of the heddle frames 1, 1'.

Figure 2:
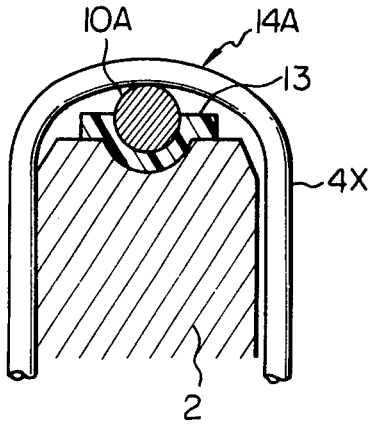
FIG. 2 is a sectional view of the heddle bar shown in FIG. 1 taken along the line II–II'.

Reference is now made to FIG. 2 which shows a sectional view of the heddle bar 2 and the relation between the heddle bar 2 and a loop 4X which hangs over the top portion of the same. An elongate electrode 10A is disposed via an insulating member 13 longitudinally along the entire top portion of the heddle bar 2. The electrode 10A is arranged to contact with the loop 4X when the loop 4X hangs over the heddle 2. All the loops 4 including the loop 4X shown in FIGS. 1 and 2, are made of electro-conductive material and conductive with the heddle bars 2, 2' at their either side. Consequently, the electrode 10A and the top portion of the loop 4X constitute a second electric switch 14A.

Switches 8A and 14A are connected in series as shown in FIG. 1, by a chain line L, and this arrangement is made for each heddle frame. With this construction, during the first switch 8A closes i.e. during the heddle bar 2 is at its lower position, if in operation, all the warps are in normal condition the heddles 3 are biased upwardly by the tension of warps. Since the upper portion of each loop 4 is spaced from the upper surface of the heddle bar 2, the second switch 14A does not close. If a warp 5X is in abnormal condition such as being broken or loosen, as shown in FIG. 1, the tension along the warp 5X disappears and the heddle 3X which keeps the warp 5X falls down by its self-weight. At this instant a loop 4X which is corresponding to the heddle 3X fell on the upper surface of the heddle bar 2 thereby the second switch 14A closes.

When both of the first and second switches 8A, 14A close simultaneously, terminals TA-1, TA-2 become conductive and a signal for stopping the operation of the loom is generated in a circuit which is not shown. The first embodiment according to the present invention is provided to generate a signal for illuminating a lamp corresponding to a heddle frame to which an abnormal warp belongs by using a signal obtained though the switches 8A, 14A.

Figure 3:
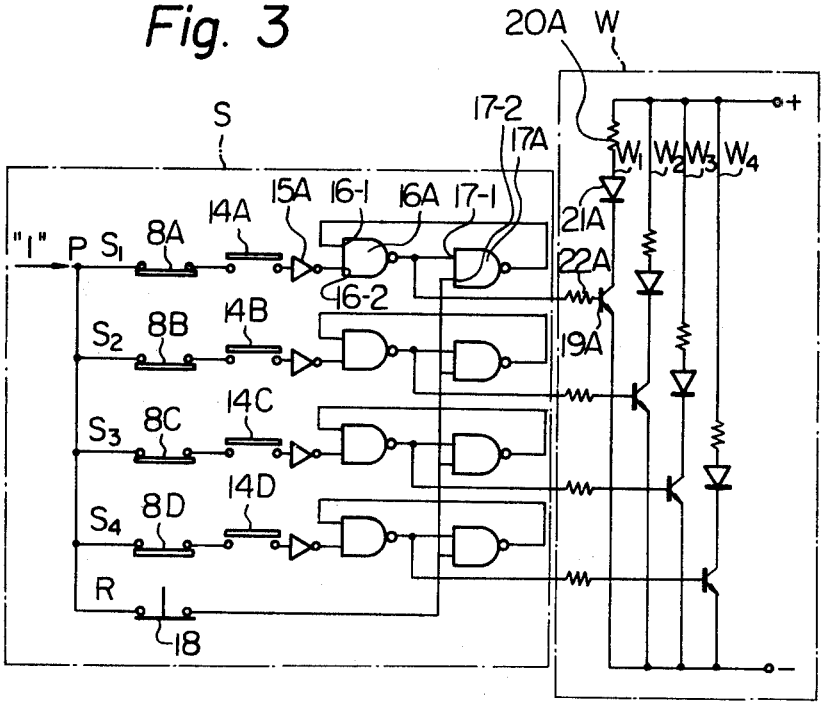
FIG. 3 shows a lamp illuminating circuitry which may by adapted to the first preferred embodiment.

Referring now to FIG. 3 which shows a lamp illuminating circuitry for lighting lamps, the circuitry comprises a illuminating signal generating circuitry S and a display circuitry W. Switches shown in FIG. 1 and 2 are also shown in the illuminating signal generating circuitry for convenience. The construction of the circuitries S, W is designed to apply for a loom having four heddle frames. However, the circuitries may be designed to adapt to looms having more heddle frames. Switching circuits $S_1$ to $S_4$ are corresponding to each heddle frame respectively where all the switching circuits $S_1$ to $S_4$ are connected at its one end with a node P which is always fed with a logic signal "1", the logic signal is produced by a logic signal generator which is not shown. The construction and the function of the switching circuits $S_1$ to $S_4$ are same therefore the description of the switching circuits is made only for the switching circuit $S_1$ which corresponds to the heddle frame 1 i.e. to heddle bar 2. The first switch 8A and the second switch 14A are connected in series where the first switch is also connected to the node P at the other terminal TA-1 thereof. An inverter 15A is interposed between the terminal TA-2 of the switch 14A and an input 16-2 of a first NAND gate 16A. An output (no numeral) of the first NAND gate 16A is coupled to an input 17-1 of a second NAND gate 17A and an output of the second NAND gate is connected to an input 16-1, which is different from the above-mentioned input 16-2, of the first NAND gate 16A. The other input 17-2 of the second NAND gate 17A is connected to a reset circuit R which comprises a reset switch 18 one of the terminal of which is coupled to the node P. The other terminal of the reset switch 18 is connected not only to the input 17-2 of the second NAND gate 17A but also to one of two inputs of other second NAND gates of the switching circuits $S_2$ to $S_4$. The reset switch 18 is a press-to-open type (normally close type) switch therefore the both terminals of the reset switch 18 is closed unless the switch 18 is pressed. The display circuitry W includes four display circuits denoted by $W_1$ to $W_4$, where each circuit corresponds respectively to the switching circuits $S_1$ to $S_4$ mentioned above. Since the display circuits $W_1$ to $W_4$ are the same in construction and the function, the description is made only for the display circuit $W_1$. A resistor 20A is inserted between a positive terminal of a power supply (not shown but denoted by (+)) and an anode of a LED (light emitting diode) 21A. The cathode of the LED 21A is coupled to a collector of a transistor 19A the emitter of which is connected to a negative or ground terminal denoted by (−) of the power supply. A base of the transistor 19A is connected via a resistor 22A to the output of the first NAND gate 16A. Other display circuits $W_2$ to $W_4$ are arranged in the same manner where each base of each transistor is connected to an output terminal of a first NAND gate (no numeral) of each switching circuit $S_2$ to $S_4$ respectively.

Now the description of the operation of the lamp illuminating circuitry S, W is made. At the beginning the lamp illuminating circuitry becomes operable after the reset switch 18 is pressed instantaneously. By opening the reset switch 18 the input 17-2 of the second NAND gate 17A is fed with logic "0" signal so that the second NAND gate 17A produces logic "1" signal at its output irrespectively of the state of the other input 17-1 of the same. The logic "1" signal at the output 17-2 is applied to the input 16-1 of the first NAND gate 16A. When warps belonging to the heddle frame which corresponds to the first and second switches 8A, 14A are normal to the logic "1" signal at the node P is not supplied to the invertor 15 because the second switch 14A is in open state even while the first switch 8A is closed. Therefore the input 16-2 of the first NAND gate 16A is supplied with a logic "1" signal by the inverter 15A. In response to the logic "1" signals at both inputs 16-1, 16-2 the first NAND gate 16A produces a logic "0" signal at its output. Since the LED 21A is designed to emit light by the current through the collector and the emitter of the transistor 19A, the LED 21A does not emit light while a logic "0" signal is fed via the resistor 22A to the base of the transistor 19A. It is apparent that if all the warps of the loom are in normal condition, viz. with certain tension, none of the LEDs of the display circuitry W emits light.

When the reset switch 18 closes again after an instantaneous opening of the same, the input 17-2 of the second NAND gate 17A is again fed with a logic "1" signal. However, since the other input terminal of the same is fed with the logic "0" signal as described hereinbefore the output of the second NAND gate 17A is still at logic "1" which is the same state as before the reset switch 18 is closed again. Consequently, the output of the first NAND gate 16A maintains the logic "0" signal irrelevant to the state of the reset switch 18 after the first opening of the same.

If in operation, a warp 5X belonging to the heddle frame 1 is abnormal as shown in FIG. 1, the second switch 14A contineously closes and at the lower position of the heddle frame 1 the first switch 8A also closes. In this case the inverter 15A produces logic "0" signal in response to the logic "1" signal fed via the first and second switches 8A and 14A from the node P to the input. With this logic "0" signal the first NAND gate 16A produces a logic "1" signal at its output irrelevant to the state of the other input 16-2 of the same. The logic "1" signal produced by the first NAND gate is then fed via the resistor 22A to the base of the first transistor 19A to drive the same and thus make the first LED 21A emit light. The output of the first NAND gate 16A is also supplied to the input 17-1 of the second NAND gate 17A while the other input 17-2 of the same is fed via the reset switch 18 with logic "1" signal. Because the both input terminals 17-1, 17-2 are supplied with logic "1" signal respectively the second NAND gate 17A produces logic "0" signal at its output which is fed to the input 16-1 of the first NAND gate 16A and thus the first NAND gate 16A maintains to produce logic "1" signal irrespective to the logic value of the other input 17-2. Namely, even after the switch 8A opens, the first NAND gate 16A keeps producing logic "1" signal for driving the corresponding transistor 19A and thus LED 21A maintains emitting light untill the reset switch 18 is pressed to open the same.

If the reset switch 18 is opened the input 17-2 of the second NAND gate 17A is fed with logic "0" signal so that the second NAND gate 17A produces logic "1" signal which is fed to the input 16-1 of the first NAND gate 16A. Then the first NAND gate 16A produces logic "0" signal at its output which does not drive the transistor 19A and thus the LED 21A any more. It is to be noted that the combination of a pair of NAND gates 16A, 17A is provided to constitute a holding circuit. This circuit may be substituted with other holding circuit.

Figure 4:
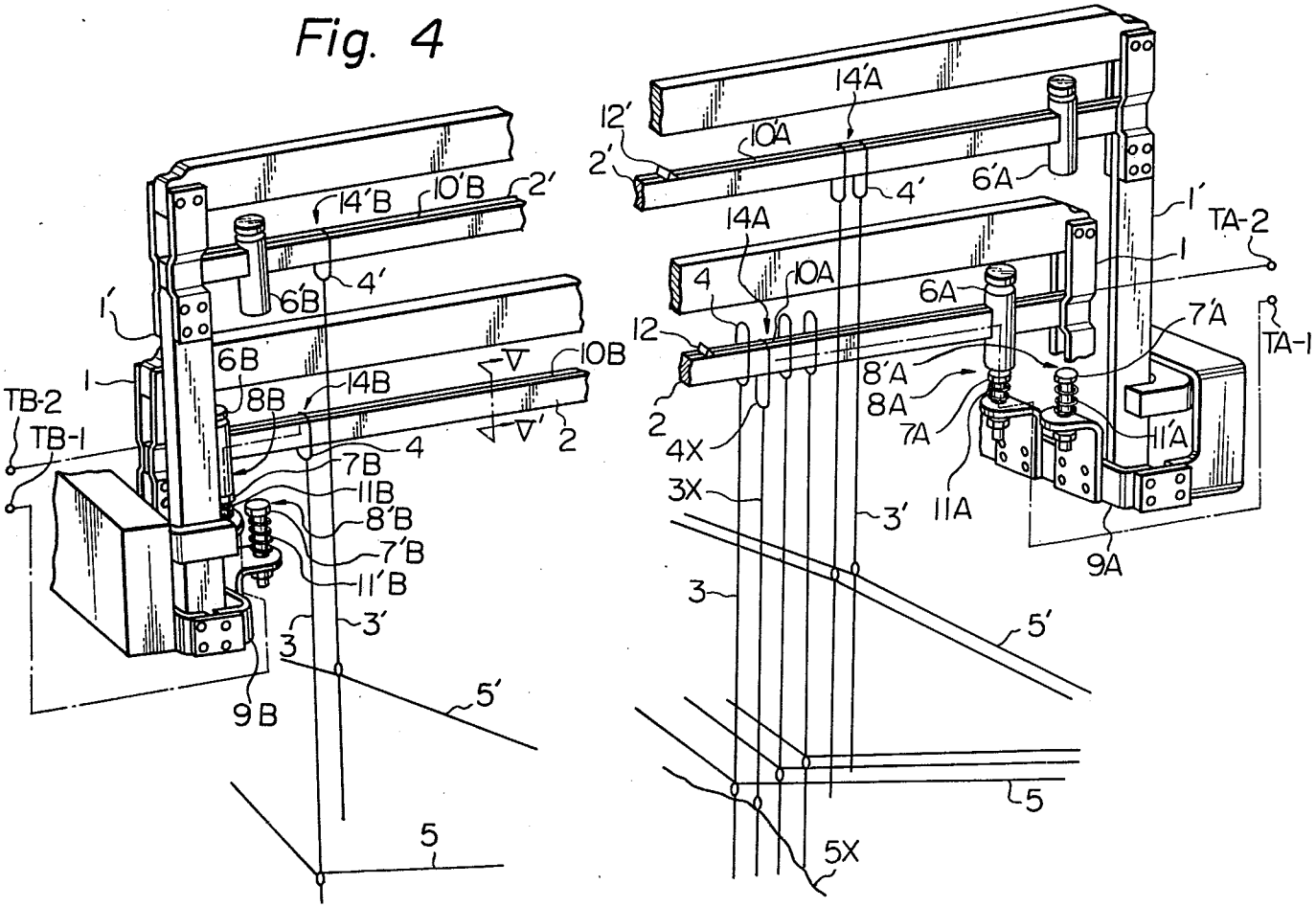
FIG. 4 shows a partly perspective view of a second embodiment of a device for detecting the loss of tension of a warp yarn according to the present invention.
Figure 5A:
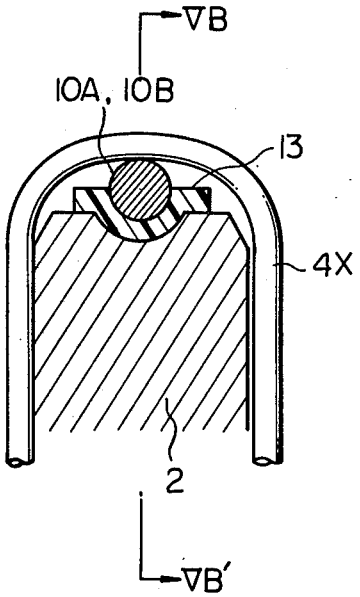
FIG. 5A is a sectional view of the heddle bar shown in FIG. 4 taken along the line V–V'.
Figure 5B:
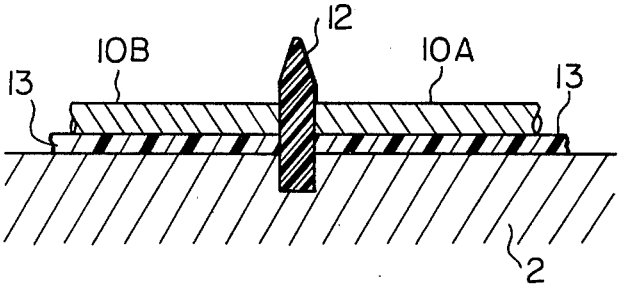
FIG. 5B is an enlarged sectional view of the heddle bar around a sharp projection mounted on the heddle bar shown in FIG. 5A taken along the line VB–VB'.

Reference is now made to FIGS. 4, 5A and 5B which show the second embodiment according to the present invention. In this embodiment both sides of the heddle frame 1, 1' are shown where the same arrangement of switches 8A, 8'A and 8B, 8'B are arranged symmetrically. Same numerals are used for the corresponding elements as the first embodiment shown in FIG. 1. The heddle bars 2, 2' have sharp triangle insulating projections 12, 12' respectively at midway of the entire length. FIG. 5A is a sectional view of the heddle bar 2 taken along the line V–V' shown in FIG. 4 and FIG. 5B shows a further sectional view of the enlarged portion of the heddle bar 2 around the insulating projection 12 taken along the line VB–VB' of FIG. 5A. The insulating projection 12 is disposed on the upper portion of the heddle bar 2 and the bottom end of the insulating projection 12 is fixedly incorporated with a recess (no numeral) of the heddle bar 2. The shape of the insulating projection 12 is upwardly so sharp that the loop 4 loosely attached besides the same slides down to the top surface of the heddle bar 2 along the either sides of the insulating projection 12 when not only the heddle frame 1 is raised but also a loop 4X hangs over the insulating porjection 12 by its weight when a corresponding warp is abnormal in case of the lower position of the heddle bar 2. Two elongate electrodes 10A, 10B are longitudinally positioned via an insulating member 13 on the top surface of the heddle bar 2 as shown in FIGS. 4, 5A and 5B. Electrodes 10A, 10B are electrically insulated by the insulating projection 12 and constitute switches 14A, 14B respectively. A pair of contacts 6A, 6B of switches 8A, 8B are disposed on the both sides of the heddle bar 2 where the construction of the switches is the same as the one described in the first embodiment. Same arrangement is made to the other heddle bar 2' which includes a pair of electrodes 10'A, 10'B, an insulating projection 12' and a pair of contacts 6'A, 6'B of switches 8'A, 8'B.

The chain lines in FIG. 4 show the connection of the switches 8A, 14A and 8B, 14B to terminals TA-1, TA-2 and TB-1, TB-2. It is now clear that in this second embodiment, the construction is the same as the first embodiment except each heddle bar 2, 2' includes a pair of elongate electrodes 10A, 10B or 10'A, 10'B, an insulating projection 12 or 12' and a pair of contacts 6A, 6B or 6'A, 6'B of switches 8A, 8B or 8'A, 8'B.

The circuitry S, W for illuminating lamps shown in FIG. 3 may be used for this second embodiment. Turning back to the FIG. 3, the combinations of switches of each switching circuit $S_1$ to $S_4$ are respectively substituted with combinations of a pair of switches 8A and 14A, 8B and 14B, 8'A and 14'A, and 8'B and 14'B which are shown in FIG. 4. Operation and the function of the illuminating circuitry S, W are the same as the first embodiment and thus the description of the same is omitted.

Since the entire length of the heddle bars 2, 2' are electrically divided into two portions each LED shown in FIG. 3 corresponds to a half portion of a heddle bar respectively. The circuitry S, W shown in FIG. 3 can be adapted to a loom having two heddle frames but it is possible to increase the number of the switching circuits and display circuits as much as desired corresponding to the number of heddle frames. It is to be understood that since each heddle bar is electrically divided into two portions it is more convenient than the first embodiment to find an abnormal warp yarn when one of the LEDs lights. This means it takes approximately a half time for finding the abnormal warp for the operator compared to the first embodiment.

Figure 6A:
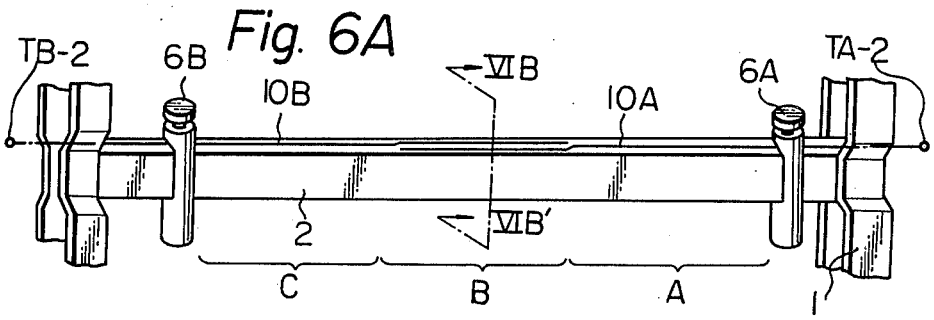
FIG. 6A shows a partly perspective view of a third embodiment of a device for detecting the loss of tension of a warp yarn according to the present invention.
Figure 6B:
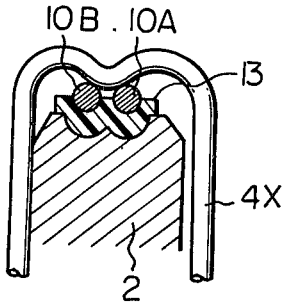
FIG. 6B is a sectional view of the heddle bar shown in FIG. 6A taken along the line VIB–VIB'.

Reference is now made to FIGS. 6A and 6B which show the third embodiment according to the present invention. The entire length of the heddle bar 2 between switches 6A and 6B are electrically divided into three portions denoted by A, B, C and two independent elongate electrodes 10A, 10B are disposed via an insulating member 13 on the top surface of the heddle bar 2. These two electrodes are designed to be parallel at the portion B and connected respectively to terminals TA-2, TB-2 where the connection is shown by chain lines in FIG. 6A. As shown in FIG. 6B these electrodes 10A, 10B are insulated from each other by a insulating member 13 and also insulating from the heddle bar 2. Each loop has a downward bent portion at the top portion thereof to facilitate connecting the electrodes 10A and 10B effectively when the loop 4 hangs over the heddle bar 2 as shown in FIG. 6B. The electrodes 10A, 10B are connected respectively via the terminals TA-2, TB-2 to each corresponding lamp lighting circuit in the same manner as described hereinbefore and the circuitry for illuminating lamps shown in FIG. 3 may be adapted.

The operation of the third embodiment is as follows. When a loop 4X which belongs to the portion A or C of the heddle bar 2 hangs over the same, a LED corresponding to the portion A or C glows and when a loop 4X belongs to the portion B hangs over the heddle bar 2, both of the LEDs which respectively correspond to the portions A and C glow.

In the third embodiment, it will be understood that since the heddle bar 2 is electrically divided into three portions, it is more convenient to find an abnormal warp compared with other emdobiments described hereinbefore.

Figure 7:
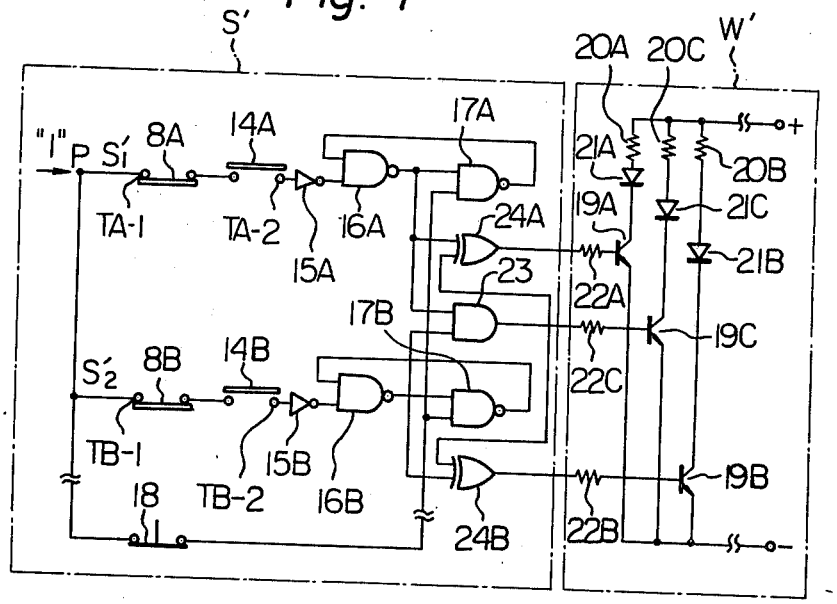
FIG. 7 shows a lamp illuminating circuitry which may be adapted to the third embodiment.

Referring now to FIG. 7 which shows a lamp illuminating circuitry S', W' which may be also adapted to the above-mentioned third embodiment, the lamp illuminating circuitry includes a illuminating signal generating circuitry S' and a display circuitry W'. Most of the arrangement is the same as the before-mentioned lamp illuminating circuitry S, W shown in FIG. 3 except that an AND gate 23 and a pair of EX (exclusive) OR gates 24A, 24B are provided. The circuitry shown in FIG. 7 is for only one heddle frame 1 and the other circuits for the other heddle frame is omitted from the figure since the construction is the same as the circuitry shown in the figure. When the lamp illuminating circuitry is adapted to a weaving loom having more than two heddle frames the number of circuits can be increased as much as desired corresponding to the number of heddle frames.

Each input of the AND gate 23 is coupled to the outputs of the first NAND gates 16A, 16B of each switching circuit S'1, S'2 respectively. Thus the AND gate 23 produces output logic signal when both outputs of the first NAND gates 16A, 16B are at logic value "1" i.e. when a loop 4X hangs over the both electrodes 10A, 10B in the portion B of the heddle bar 2 as shown in FIG. 6A, 6B. An input of the first EX OR gate 24A is also connected to the output of the first NAND gate 16A and the other input of the first EX OR gate 24A is connected to the output of the AND gate 23. An input of the second EX OR gate 24B is connected to the output of the first NAND gate 16B and the other input of the second EX OR gate is also connected to the output of the AND gate 23. The outputs of the first and second EX OR gates 24A, 24B are connected via resistors 22A, 22B to bases of first and second transistors 19A, 19B respectively and the output of the AND gate 23 is connected via resistor 22C to a base of a third transistor 19C. It will be appreciated that when switches 8A and 14A closes simultaneously the invertor 15A is fed with logic "1" signal and thus produces logic "0" signal at its output which is supplied to the first NAND gate 16A. Then the NAND gate 16A produces logic "1" signal at its output irrespectively to the logic value of the other input of the same, thereby the logic "1" signal is provided to the AND gate 23 and the EX OR gate 24A. The function of the switching circuit $S_2'$ and other switching circuits which are not shown in the figure is the same as that of the circuit $S_1'$. When a loop 4X hangs over the portion B of the heddle bar 2 shown in FIG. 6A both outputs of the first NAND gate 16A, 16B are at logic value "1" and the AND gate produces logic "1" signal to drive the transistor 19C and thus the LED 21C emits light therefrom. Since both inputs of each EX OR gate 24A, 24B are supplied with logic "1" signal, none of the EX OR gate generates logic "1" signal at its output and LED 21A and 21B thereby do not emit light. If the loop 4X hangs over the portion A shown in FIG. 6A, the output of the first NAND gate of the second switching circuit S'2 is at logic value "0" while the output of the first NAND gate 16A is at logic value "1" and thus the AND gate 23 does not drive the transistor 19C. The first EX OR gate 24A is fed with logic "1" and "0" signals respectively at its inputs thereby produces logic "1" signal to drive the transistor 19A i.e. the LED 21A while the second EX OR gate 24B generates logic "0" signal because of logic "0" input signals at both inputs.

Now it is apparent with this lamp illuminating circuitry S', W' shown in FIG. 7, a LED corresponding to each portion A, B or C emits light displaying the portion of the heddle 2 to which an abnormal warp yarn belongs.

Figure 8A:
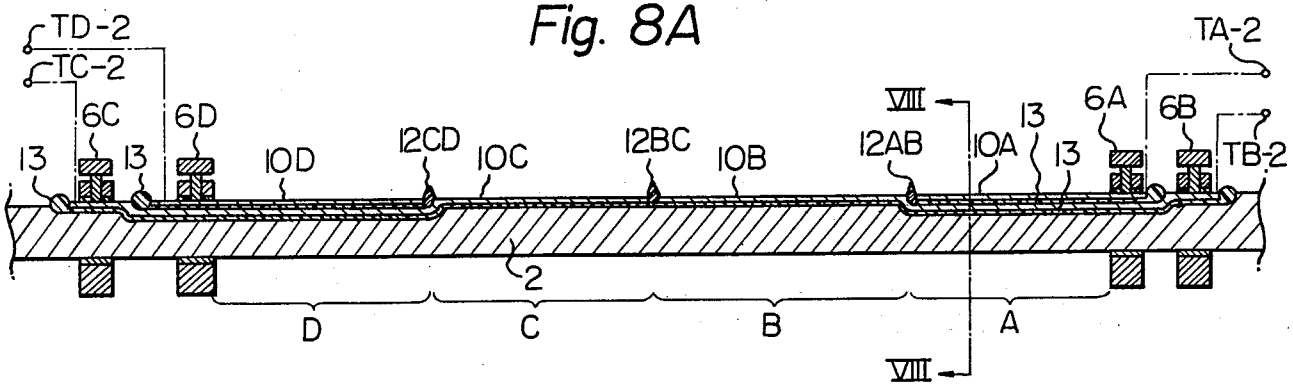
FIG. 8A shows a schematic view of a fourth embodiment of a device for detecting the loss of tension of a warp yarn according to the present invention.
Figure 8C:
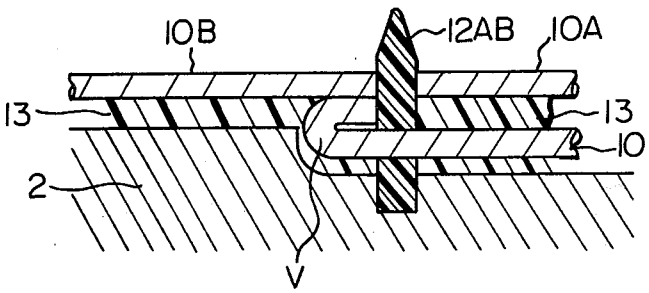
FIG. 8C is an enlarged view of the heddle bar shown in FIG. 8A around one of the sharp triangle insulating projections.
Figure 8B:
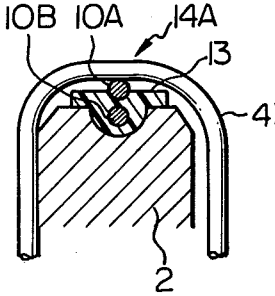
FIG. 8B is a sectional view of the heddle bar shown in FIG. 8A taken along the line VIII–VIII'.

Reference is now made to FIGS. 8A, 8B and 8C which show the fourth embodiment. The heddle bar 2 includes four portions A, B, C, D which are electrically independent as shown in FIG. 8A. There are disposed four elongate electrodes 10A, 10B, 10C, 10D via an insulating member 13 on the top surface of the heddle bar 2. Further the electrodes 10A to 10D are insulated each other not only by the insulating member 13 but also insulating projections 12AB, 12BC, 12CD. These insulating projections are such as those described in the second embodiment shown in FIGS. 4 and 5B. Since the construction of the heddle bar 2 with electrodes 10A to 10B is symmetrical the description of the right half portion of the heddle bar 2 shown in FIG. 8A is made. The electrode 10A is positioned above the half of the other electrode 10B in vertically parallel position as shown in FIGS. 8A, 8B, 8C and the rest of the electrode 10B is positioned co-axially with the other electrode 10A. The electrode 10B has a bent portion denoted by V beside the insulating projection 12AB as shown in FIG. 8C. With this arrangement the heddle bar 2 has four electrically independent portions.

Each electrode 10A to 10D is connected at its one end to terminals TA-2, TB-2, TC-2, TD-2 respectively as shown in FIG. 8A to be connected to a lamp illuminating circuitry. The same lamp illuminating circuitry S, W as the first embodiment shown in FIG. 3 may be adapted. Since the operation of the circuitry is described hereinbefore it is omitted. It is now apparent that a LED which corresponds to one of the portions of the heddle bar 2 emits light when a loop 4X hangs over the portion. Since the circuitry shown in FIG. 3 includes only four switching circuits $S_1$ to $S_4$ and displaying circuits $W_1$ to $W_4$ this circuitry may be adapted to only one heddle bar of one heddle frame. Therefore the number of switching circuits and displaying circuits may be increased corresponding to the number of heddle frames so as to facilitate the operator of the loom to find a place to which a loop i.e. a heddle which supports an abnormal warp yarn belongs with much less time.

What is claimed is:

1. A device for detecting the loss of tension of a warp yarn in a weaving loom with at least two heddle frames which alternatively move up and down, comprising:

at least two switching means for detecting a lower position of a corresponding heddle frame, by passing an electric current therethrough;

an upper heddle bar fixedly connected to said each heddle frame, said upper heddle bar including a plurality of first electro-conductive portions insulated from each other, each of said first electro-conductive portions being so arranged on said upper heddle bar that the entire length of said upper heddle bar is electrically divided into a plurality of portions, and a longitudinal second electro-conductive portion which extends along said upper bar, means insulating said second electro-conductive portion from said first electro-conductive portions, means for connecting said second electro-conductive portion electrically to said switching means;

a plurality of heddles, each of said heddles having upper and lower loops at both ends thereof, said upper and lower loops being loosely coupled to said upper heddle bar and a lower heddle bar of the each heddle frame respectively, the upper loop being made of an electro-conductive material, each heddle assuming an upper position with respect to the upper heddle bar when normal tension of a warp connected to the heddle is provided to the heddle for pushing up the same during which the heddle bar is at a lower position thereof, each said heddle assuming a lower position when the tension of said warp is lost during which said heddle bar is at the lower position thereof, said upper loop of a heddle being spaced from said first electro-conductive portion when the heddle assumes an upper position, said upper loop of a heddle being disposed for coming into contact with said first and second electroconductive portions of said upper heddle bar when the heddle assumes a lower position; and display means including a plurality of electrical circuitry respectively connected to each of said first electro-conductive portions for indicating a portion of a heddle bar to which a heddle having a broken warp is connected.

2. A device as claimed in claim 1, wherein each of said upper heddle bar includes a pair of elongate electrodes separated and insulated from each other at the midway point of the heddle bar, said electrodes extending from each end of the heddle bar respectively, and an upwardly sharp insulating member positioned on the midway point of the heddle bar.

3. A device as claimed in claim 1, wherein each of said upper heddle bar includes a pair of elongate electrodes, each electrode being longer than the half length of the entire length of the heddle bar and shorter than the entire length of the heddle bar and extending from each end of the heddle bar respectively and being positioned in parallel where the electrodes are doubled.

4. A device as claimed in claim 3, wherein each of said upper loops has a downward bent portion at its top portion.

5. A device as claimed in claim 1, wherein each of said upper heddle bar includes first, second, third and fourth elongate electrodes, said first and second electrodes being slightly shorter than a half length of the heddle bar and extending from each end of the heddle bar respectively, each of said first and second electrodes having a bent portion respectively at its midway portion and each half portion which is close to the end of the heddle bar being lowered from the vertical level of the other half portion which is exposed, said lowered portion of each first and second electrodes being covered with an insulating member respectively, said third and fourth electrodes being slightly shorter than the half length of the first and second electrodes and also extending from each end of the heddle bar respectively and being positioned above said lowered portion of each of said first and second electrodes and in parallel with the same and being exposed and three upwardly sharp insulating members positioned on said heddle bar, two of said members being adjacent to each bent portion and the other being at the midway point of the heddle bar.

6. A device as claimed in claim 1, wherein said position detector is a switch, having contacts respectively disposed on said heddle bar and on the body of the loom.

7. A device as claimed in claim 6, wherein a pair of said switches are provided for each heddle frame.

8. A device as claimed in claim 1, wherein each said display circuit comprises a holding circuit for maintaining the illumination of said display means, said each display circuitry further comprising a reset circuit for resetting the holding circuit.

* * * * *